US007607444B2

(12) United States Patent
Gunnerson et al.

(10) Patent No.: US 7,607,444 B2
(45) Date of Patent: Oct. 27, 2009

(54) LATCHING AND SEALING MECHANISM FOR A DRAWER-TYPE DISHWASHER

(75) Inventors: Kory A. Gunnerson, West Lafayette, IN (US); Kristen K. Hedstrom, Orlando, FL (US); Michael J. Kramer, Atlanta, GA (US); Mark E. Palm, Orlando, FL (US); Rodney M. Welch, Jackson, TN (US)

(73) Assignee: Maytag Corporation, Benton Harbor, MI (US)

( * ) Notice: Subject to any disclaimer, the term of this patent is extended or adjusted under 35 U.S.C. 154(b) by 766 days.

(21) Appl. No.: 11/288,290

(22) Filed: Nov. 29, 2005

(65) Prior Publication Data

US 2007/0119485 A1 May 31, 2007

(51) Int. Cl.
*B08B 3/00* (2006.01)

(52) U.S. Cl. ..... 134/200; 292/4; 292/5; 292/6; 312/226; 134/56 D

(58) Field of Classification Search ..... 292/5; 312/226; 134/56 D
See application file for complete search history.

(56) References Cited

U.S. PATENT DOCUMENTS

| | | | | |
|---|---|---|---|---|
| 2,668,091 | A | 2/1954 | Clark | |
| 3,131,981 | A * | 5/1964 | Scott et al. | 312/222 |
| 3,388,626 | A * | 6/1968 | Larson | 83/261 |
| 5,755,244 | A | 5/1998 | Sargeant et al. | |
| 6,189,551 | B1 | 2/2001 | Sargeant et al. | |
| 6,460,555 | B1 | 10/2002 | Tuller et al. | |
| 6,491,049 | B1 | 12/2002 | Tuller et al. | |

FOREIGN PATENT DOCUMENTS

| | | |
|---|---|---|
| CA | 2 353 656 | 2/2002 |
| EP | 578862 | 1/1994 |
| EP | 1 417 923 | 5/2004 |
| JP | 2000139797 | 5/2000 |
| JP | 2000139799 | 5/2000 |
| JP | 2001046300 | 2/2001 |
| JP | 2001046303 | 2/2001 |
| JP | 2001046304 | 2/2001 |
| JP | 2001046305 | 2/2001 |
| JP | 2001046306 | 2/2001 |
| JP | 2001061749 | 3/2001 |
| JP | 2001087200 | 4/2001 |

(Continued)

*Primary Examiner*—Michael Barr
*Assistant Examiner*—Jason Y Ko
(74) *Attorney, Agent, or Firm*—John W. Morrison; Diederiks & Whitelaw PLC

(57) ABSTRACT

A dishwasher includes a drawer which is slidably mounted in a frame and forms a washing chamber. A lid assembly is mounted to the frame for selectively sealing the washing chamber during a washing operation. A closing mechanism moves the lid assembly from a first or open position to a second or closed position that provides a water-tight seal during a washing operation. The dishwasher is further provided with a latching mechanism including a pivoting door front member, a locking member and a linking bar interconnecting the door front member with the locking member. Manipulation of the pivoting drawer front member causes the locking member to engage/disengage with the lid assembly. The latching mechanism further includes a locking bar and a micro-switch that combine to prevent operation of the dishwasher if the drawer is not properly positioned in the frame.

17 Claims, 6 Drawing Sheets

FOREIGN PATENT DOCUMENTS

| | | |
|---|---|---|
| JP | 2001275912 | 10/2001 |
| JP | 2001275913 | 10/2001 |
| JP | 20011275916 | 10/2001 |
| JP | 2002017642 | 1/2002 |
| JP | 2002065570 | 3/2002 |
| JP | 20020143072 | 5/2002 |
| JP | 2002165744 | 6/2002 |
| JP | 2002200026 | 7/2002 |
| JP | 200223882 | 8/2002 |
| JP | 2002282192 | 10/2002 |
| JP | 2002345716 | 12/2002 |
| JP | 2002360495 | 12/2002 |
| JP | 2003000518 | 1/2003 |
| JP | 2003024258 | 1/2003 |
| JP | 2003038406 | 2/2003 |
| JP | 2003093309 | 4/2003 |
| JP | 2003093313 | 4/2003 |
| JP | 2004 194695 | 7/2004 |
| JP | 2005 087265 | 4/2005 |
| KR | 2002045815 A | 6/2002 |

* cited by examiner

LATCHING AND SEALING MECHANISM FOR A DRAWER-TYPE DISHWASHER

BACKGROUND OF THE INVENTION

1. Field of the Invention

The present invention pertains to the art of dishwashers and, more particularly, to a latching and sealing mechanism for a drawer-type dishwasher.

2. Discussion of the Prior Art

In general, dishwashers having pull-out drawers are known in the art. In some cases, the dishwasher will include an upper, pull-out drawer forming a washing chamber for washing smaller objects, such as glassware, utensils, small plates and the like, and a lower, conventional-type dishwasher. In other cases, the dishwasher will include upper and lower pull-out washing chambers, or just simply include a single pull-out type washing chamber. In any event, each pull-out washing chamber must be provided with a lid with a water-tight seal to prevent washing fluid from leaking from the dishwasher during a washing operation.

Typically, the lid is pivotally mounted to the dishwasher above the pull-out washing chamber. With this arrangement, the lid is elevated from the washing chamber when the drawer is withdrawn from the dishwasher, and lowered onto the washing chamber when the drawer is inserted back into the dishwasher. This design requires a seal or gasket to be provided on either the lid or the washing chamber. More often than not, the gasket is located about a peripheral portion of the lid.

In addition to the gasket, a force is required to seat the lid against the washing chamber to ensure a water-tight seal. Manufacturers have developed a variety of methods for establishing a water-tight seal between the lid and washing chamber. In one example, an inflatable gasket is secured about the lid. Once the lid is lowered against the washing chamber, a solenoid activated valve is operated to inflate the seal by delivering an air flow generated by a compressor. In another example, the lid is drawn against the washing chamber through operation of a motor driven worm gear. In either case, the systems required to establish the seal are complex and prone to failure, both of which, in the case of consumer appliances, are undesirable characteristics.

Based on the above, there still exists a need in the art for an enhanced latching mechanism for a drawer-type dishwasher. More specifically, there exists a need for a latching mechanism that will bias a sealing lid against a washing chamber without requiring additional, complex support elements, such as motors, compressors and the like.

SUMMARY OF THE INVENTION

The present invention is directed to a dishwasher including a drawer forming a washing chamber slidably mounted in a frame assembly. The drawer is provided with a lid assembly pivotally mounted to the frame for selectively sealing the washing compartment during a washing operation. The drawer is also provided with first and second spray arms for spraying a washing fluid onto objects within the washing chamber. More, specifically, a first spray arm is located in a bottom portion of the drawer and a second spray arm is mounted to the lid assembly.

In accordance with a preferred embodiment of the present invention, the lid assembly includes a closing mechanism. More specifically, the closing mechanism includes a four-bar, over-center linkage mounted to the frame for moving the lid assembly between first and second positions. The first position enables the drawer to slide from the frame assembly and the second position forces the lid assembly against the drawer to seal the washing chamber.

In accordance with the most preferred embodiment, the dishwasher is provided with a latching mechanism to selectively retain the drawer within the frame during the washing operation. More specifically, the latching mechanism includes a pivoting drawer front, a locking member mounted to the drawer and a linking bar interconnecting the drawer front with the locking member. The latching mechanism is operated by pivoting the drawer front, which causes the locking member to engage/disengage a locking pin carried by the lid assembly. A locking bar is provided to engage with the locking member when the drawer is withdrawn from the frame. In addition, a micro-switch is positioned adjacent to a the locking member. The micro-switch further prevents operation of the dishwasher if the drawer is not properly seated within the frame.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
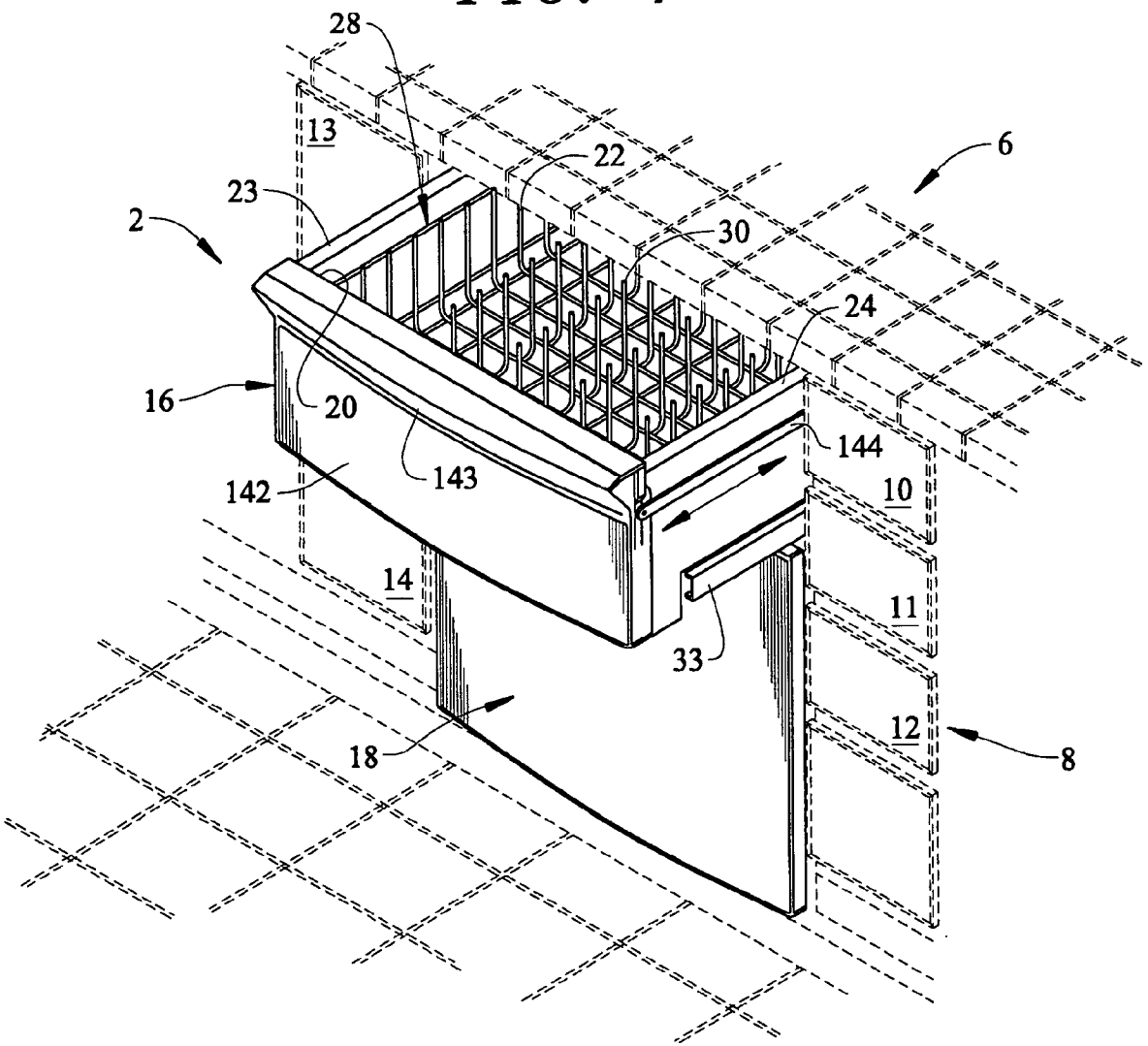
FIG. 1 is an upper right perspective view of a dishwasher incorporating a latching and sealing mechanism constructed in accordance with the present invention.
Figure 2:
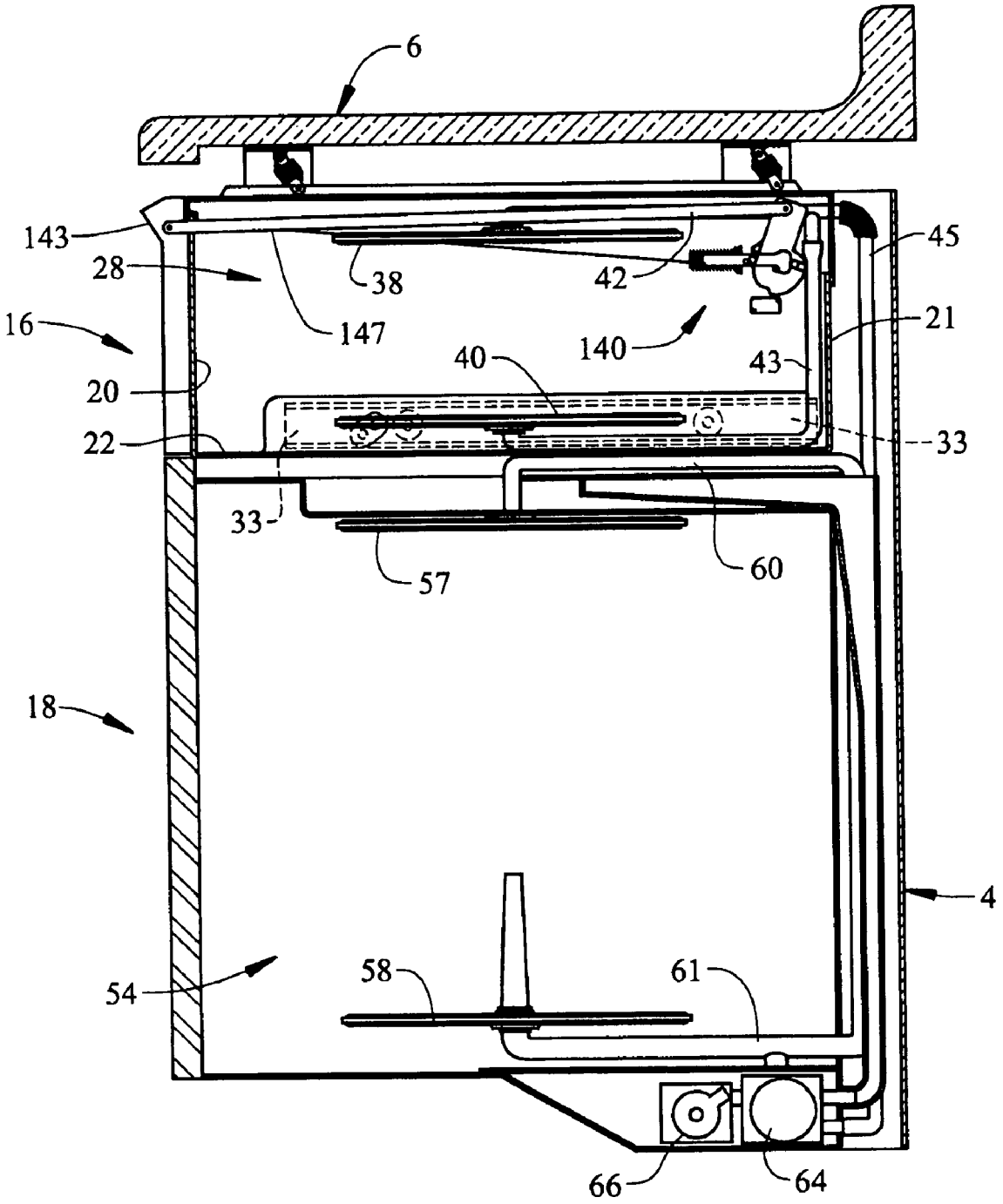
FIG. 2 is a cross-sectional, plan view of the dishwasher of FIG. 1.

With initial reference to FIGS. 1-2, a dishwasher constructed in accordance with the present invention is generally indicated at 2. As shown, dishwasher 2 includes a support frame 4 that is arranged below a kitchen countertop 6. Also below kitchen countertop 6 is shown cabinetry 8 including a plurality of drawers 10-12, as well as cabinet doors 13 and 14. Although the actual dishwasher into which the present invention may be incorporated can vary, the invention is shown in connection with dishwasher 2 depicted as a dual cavity dishwasher having an upper washing unit 16 and a lower washing unit 18. As further illustrated, upper washing unit 16 takes the form of a slide-out drawer unit, while lower cavity 18 is illustrated as a conventional-type dishwasher.

In accordance with a preferred form of the invention, upper washing unit or drawer 16 is shown to include a front wall 20, a rear wall 21, a bottom wall 22 and opposing side walls 23, 24 that collectively define an upper washing chamber 28. In a manner known in the art, upper washing chamber 28 is provided with a wire dish rack for supporting various objects, such as dishware, glassware, and the like, to be exposed to a washing operation. Also, upper washing unit 16 is slidably supported within support frame 4 through a pair of drawer support guides, one of which is indicated at 33.

With particular reference to FIG. 2, upper washing unit 16 is provided with a lid assembly 35 which, as will be discussed more fully below, is provided to selectively seal upper washing chamber 28 during a washing operation. As further shown in FIG. 2, upper washing chamber 28 is provided with a plurality of spray arms for directing a washing liquid onto objects placed within washing chamber 28. Toward that end, an upper spray arm 38 is arranged on lid assembly 35 for directing washing liquid downward onto objects within washing chamber 28, and a lower spray arm 40 is arranged above bottom wall 22 for directing washing liquid upwardly onto the objects contained within washing chamber 28. Upper and lower spray arms 38 and 40 are supplied by conduits 42 and 43, each of which is interconnected to a main or upper supply conduit 45.

On the other hand, as shown, lower washing unit 18 is provided with a lower washing chamber 54 having a plurality of spray arms adapted to direct a washing liquid onto articles placed within lower washing unit 18. As shown, lower washing chamber 54 is provided with an upper spray arm 57 for directing the washing liquid downward onto the articles placed within lower washing unit 18, as well as a lower spray arm 58 for directing the washing liquid upwardly onto the articles. Upper and lower spray arms 57 and 58 are supplied by respective conduits 60, and 61 that, along with main supply 45, interconnect with a pump 64 driven by a motor 66. Finally, upper and lower washing units 16 and 18 are provided with respective drain portions (not shown) for removing the washing liquid from upper and lower washing chambers 28 and 54 respectively. In general, the structure described above does not constitute part of the present invention, but rather has only been described for the sake of completeness. Instead, the present invention is particularly directed to a latching and sealing mechanism for raising and lowering lid assembly 35 onto washing chamber 28.

Figure 3:
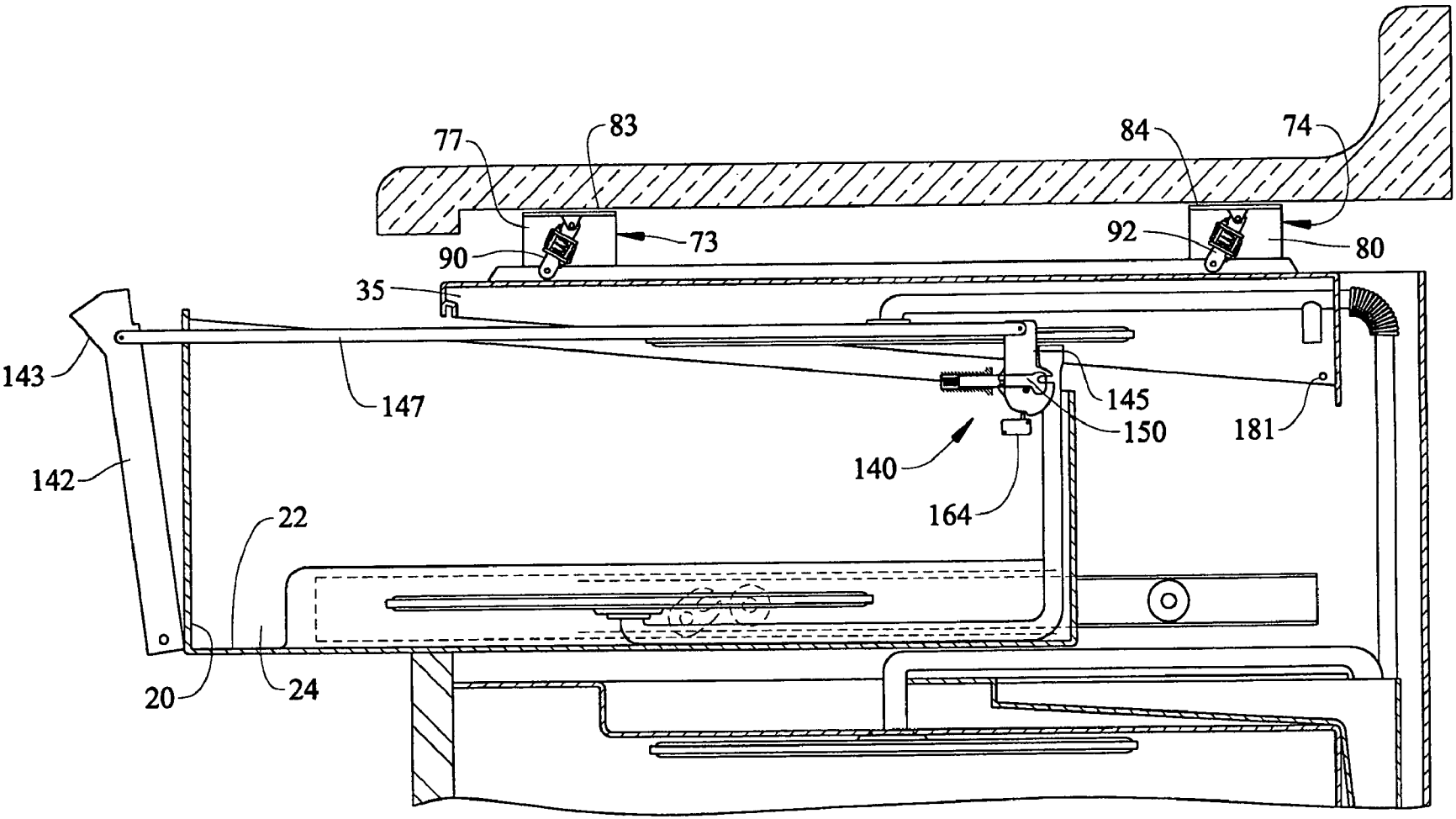
FIG. 3 is a partial, cross-sectional plan view of the dishwasher of FIG. 2 depicting the latching and sealing mechanism constructed in accordance with the present invention.
Figure 4:
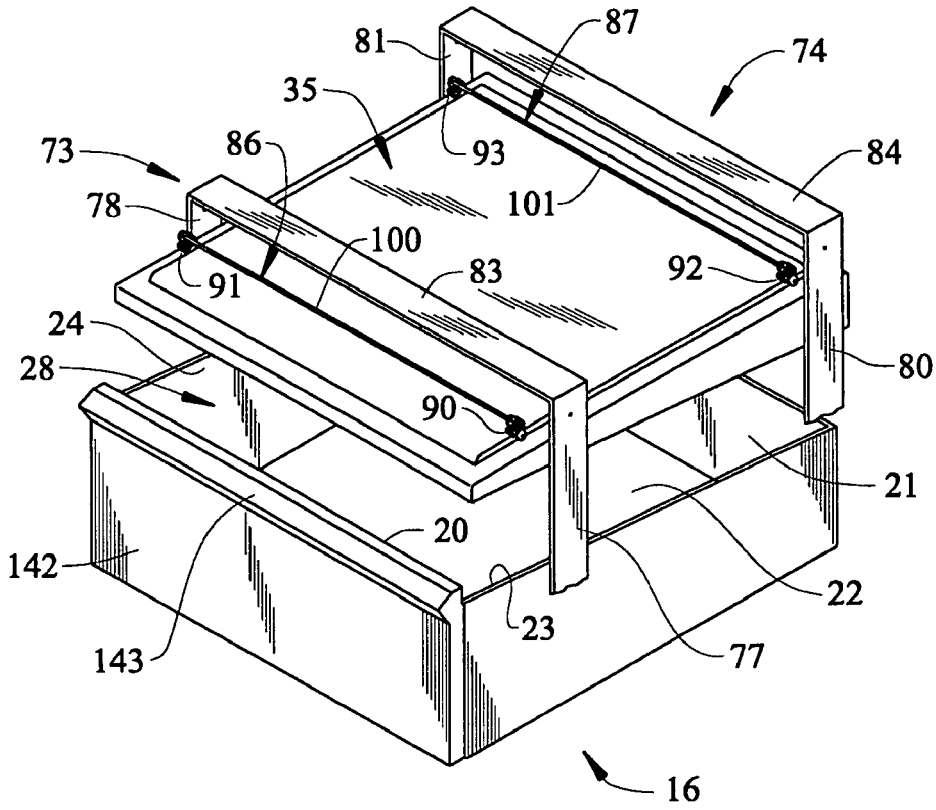
FIG. 4 is a partially exploded, upper right perspective view illustrating the sealing mechanism of the present invention.

With particular reference to FIGS. 3 and 4, the latching and sealing mechanism of the invention is shown to include a pair of U-shaped support frames 73 and 74, each of which includes a respective pair of support bars 77, 78 and 80, 81 interconnected through respective cross pieces 83 and 84. In accordance with the preferred form of the invention, U-shaped support frames 73 and 74 are provided to support lid assembly 35 for movement relative to upper washing chamber 28. Lid assembly 35 must be raised in order to permit upper washing unit 16 to be withdrawn from support frame 4. Toward that end, lid assembly 35 is provided with a sealing or closing mechanism having a pair of linkage assemblies 86 and 87 for selectively raising and lowering lid assembly 35 relative to upper washing chamber 28. While a variety of linkage assemblies can be utilized, linkage assemblies 86 and 87 are preferably constituted by four bar linkages having an over-center position which, as will be discussed more fully below, biases lid assembly 35 into each of the open and closed positions. Toward that end, linkage assemblies 86 and 87 include first and second pairs of linking members 90, 91, and 92, 93, which are interconnected through respective connecting bars 100 and 101. In accordance with the most preferred form of the present invention, linking members 90, 91 and 92, 93 are constituted by compressive link tolerance accumulators which, as will be discussed more fully below, provide a biasing force that aids in retaining lid assembly 35 in its open and closed positions.

Figure 5:
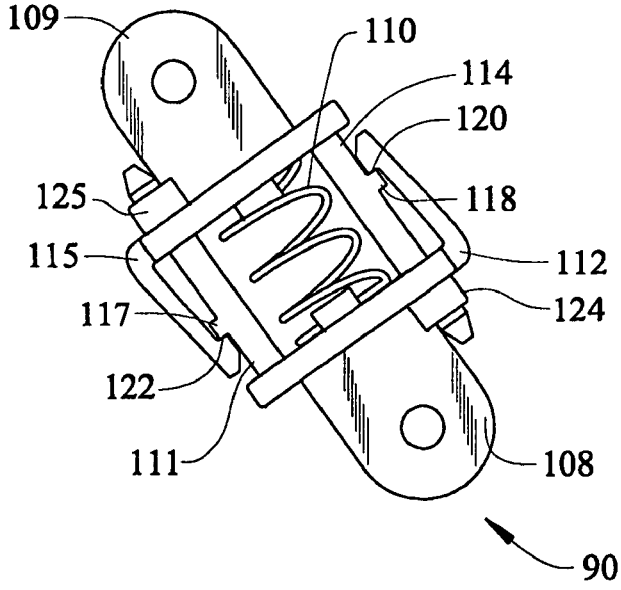
FIG. 5 is a plan view of a compressive link tolerance accumulator provided as part of the sealing mechanism shown in FIG. 3.

Reference will now be made to FIG. 5 in describing the specific structure of linking members 90-93. Since the structure of each linking member 90-93 is identical, a detailed description of linking member 90 will be made and it is to be understood that linking members 91-93 have commensurate structure. As illustrated, linking member 90 includes a first segment 108 slidingly connected to, and maintained in a spaced relationship from, a second segment 109 through a spring 110. In accordance with the most preferred form of the present invention, first segment 108 includes a guide member 111 and a stop member 112. Similarly, second segment 109 includes a guide member 114 and a stop member 115. Preferably, guide members 111 and 114 are provided with respective end stops 117 and 118. End stops 117 and 118 are adapted to interengage with hook members 120 and 121, arranged at a terminal end portion of stop members 112 and 115 respectively, to limit the travel of first and second segments 108 and 109. Finally, each of first and second segments 108 and 109 is provided with a guide block 124, 125 having a central opening (not separately labeled) adapted to receive a corresponding one of guide members 111 and 114.

Figure 6:
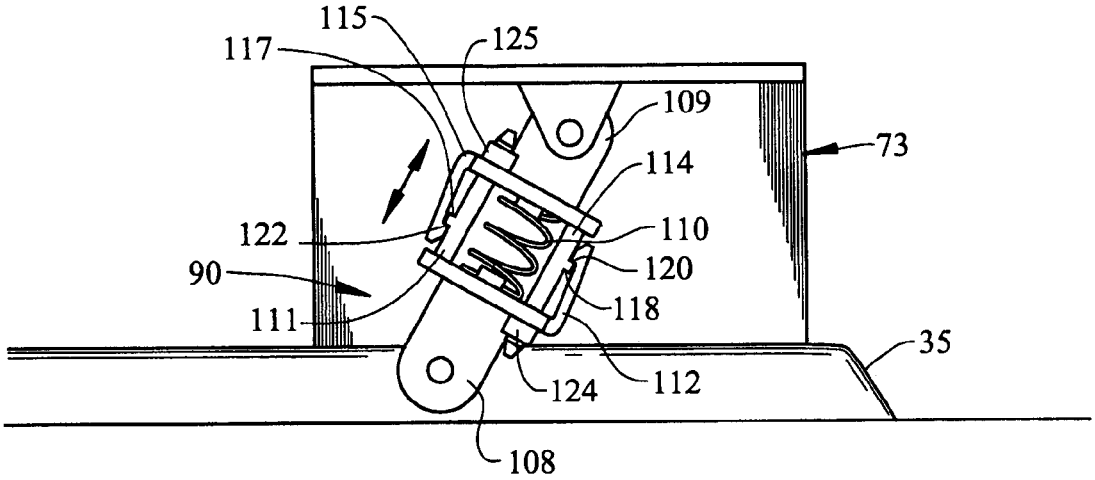
FIG. 6 is a partial plan view of the sealing mechanism of the present invention shown in a raised position.
Figure 7:
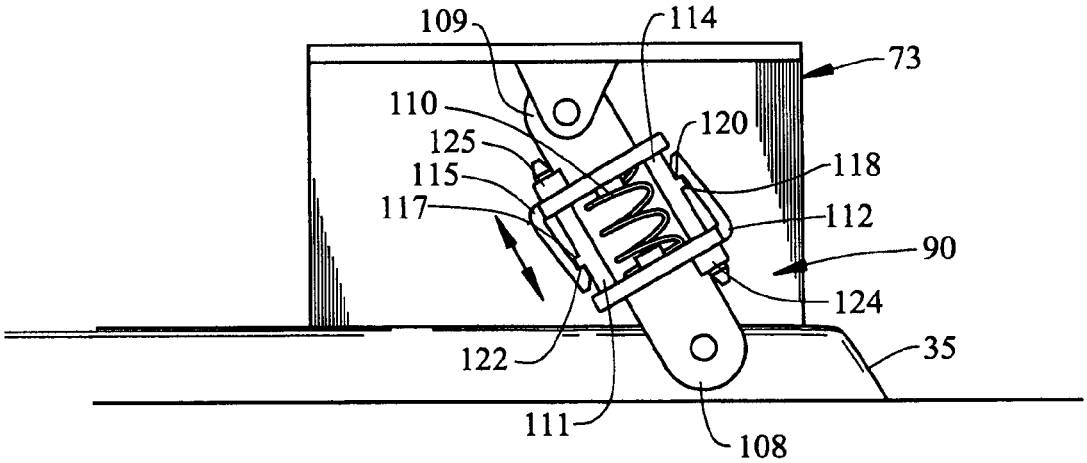
FIG. 7 is a partial plan view of the sealing mechanism of the present invention shown in a lowered position.

With this arrangement, as illustrated in FIGS. 6 and 7, linking assemblies 86 and 87 rotate from a first position, wherein lid assembly 35 is biased against upper washing chamber 28, to a second position wherein lid assembly 35 is elevated from upper washing chamber 28. As linkage assemblies 86, 87 rotate, linking members 90-93 begin to compress as linking assemblies 86 and 87 reach an over-center position. Once linkage assemblies 86 and 87 pass the over-center position, spring 110 forces first and second segments 108 and 109 apart causing lid assembly 35 to remain in the respective open or closed position as will be discussed more fully below.

Figure 8:
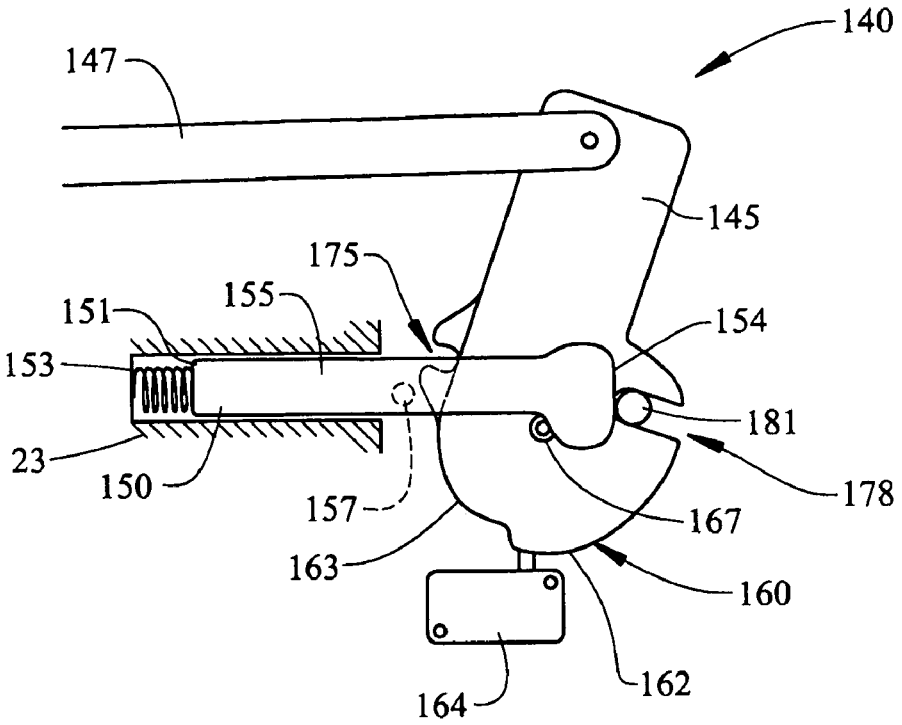
FIG. 8 is a partial plan view of the latching mechanism of the present invention shown in a latched position.
Figure 9:
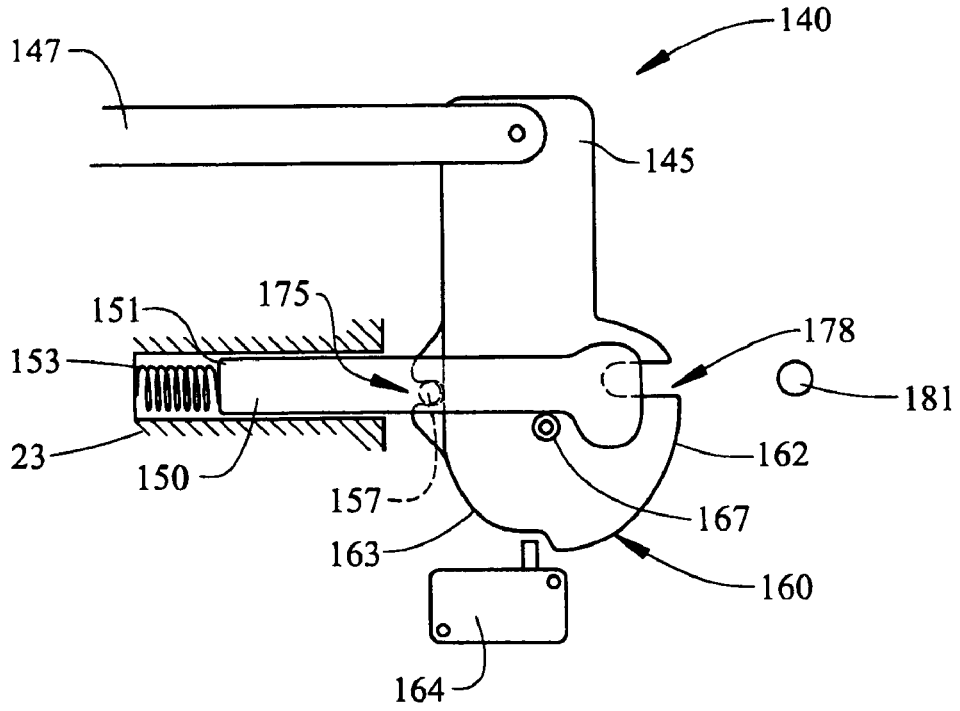
FIG. 9 is a partial plan view of the latching mechanism of the present invention shown in an unlatched position.

In further accordance with the preferred form of the present invention, not only is it necessary to seal upper washing unit 16 during a washing operation, it is desirable to prevent activation of dishwasher 2 when lid assembly 35 is in an elevated position. Toward that end, dishwasher 2 is provided with a latching mechanism 140 (see FIGS. 2 and 3). As best shown in FIG. 3, latching mechanism 140 includes a pivoting door member 142 having a handle or latching member 143, a locking member 145 and a linking bar 147 that interconnects door member 142 with locking member 145. In addition, latching mechanism 140 is provided with a locking bar 150 that prevents door member 142 from pivoting to a fully closed position when upper washing unit 16 is open. As best shown in FIGS. 8 and 9, locking bar 150 includes a first end 151 engaged by a spring 153 that is carried by side wall 23 of upper washing unit 16. More specifically, first end 151 extends to a second end 154 through an intermediate portion 155. As will be detailed more fully below, intermediate portion 155 is provided with a laterally projecting locking pin 157 adapted to engage with locking member 145 when upper washing unit 16 is withdrawn from support frame 4.

With continued reference to FIGS. 8 and 9, locking member 145 includes a cammed surface 160 having first and second camming members 162 and 163. Camming members 162 and 163 are used to control the activation of a micro-switch 164 as locking member 145 is rotated about a pivot pin 167. Micro-switch 164 actually serves as a safety interlock feature that prevents activation of dishwasher 2 unless upper washing unit 16 is fully seated within support frame 4. That is, as upper washing unit 16 is inserted into support frame 4, locking member 145 rotates from the position shown in FIG. 8 to the position shown in FIG. 9 about pivot pin 167 which, in turn, causes cammed surface 160 to engage micro-switch 164. When upper washing unit 16 is withdrawn from support frame 4, cammed surface 160 disengages from micro-switch 164, thereby creating an open circuit that prevents dishwasher 2 from being activated.

Actually, in addition to micro-switch 164, latching mechanism 140 is provided with a second safety lock feature which, as stated previously, prevents door member 142 from being fully seated when upper washing unit 16 is withdrawn from support frame 4. As best shown in FIGS. 2-3 and 6-9, locking member 145 is provided with a first pin receiving notch 175 adapted to receive locking pin 157, and a second pin receiving notch 178 adapted to receive a second locking pin 181 carried by lid assembly 35.

With this arrangement, when washing unit 16 is in an operational position as represented in FIG. 2, locking member 145 captures locking pin 181 in second pin receiving notch 178 (FIG. 8), thus preventing lid 35 from elevating. In order to shift upper washing unit 16 outward, a force is applied to latching member 143 causing linking bar 147 to rotate locking member 145 so as to disengage or release locking pin 181 from within second pin receiving notch 178. As locking member 145 is rotated, locking bar 150 shifts forward against the force of spring 153 and locking pin 157 nests within first pin receiving notch 175. In this position, door member 142 is prevented from rotating toward upper washing unit 16 and upper washing unit 16 can be fully withdrawn from support frame 4 to load or unload dishware or the like.

In order to return upper washing unit 16 from the position of FIG. 3 to the position of FIG. 2, force is applied to door member 142 to shift upper washing unit 16 into support frame 4 upon support guides 33. As upper washing unit 16 travels rearward, pin 181 becomes located in second pin receiving notch 178 and engages locking bar 150. Continued rearward shifting of upper washing unit 16 causes locking bar 150 to shift forward so as to disengage locking pin 157 from first pin receiving notch 175. At this point, locking member 145 is free to rotate in order to fully capture locking pin 181 and to draw lid 35 downward onto upper washing chamber 16. As locking member 145 rotates, pin 181 shifts both rearward and downward causing linking members 90-93 to initially compress (FIG. 6) and allow linkage assemblies 86 and 87 to reach an over-center position. Once linkage assemblies 86 and 87 pass the over-center position (FIG. 7), spring 110 forces first and second segments 108 and 109 apart, causing lid assembly 35 to be biased against upper washing chamber 16. With this construction, latching mechanism 140 incorporates both mechanical and electrical safety interlock features. In this manner, it is assured that dishwasher 2 will not activate when lid assembly 35 is in an elevated position.

Although described with reference to a preferred embodiment of the present invention, it should be readily apparent of one of ordinary skill in the art that various changes and/or modifications can be made to the invention without departing from the spirit thereof. For instance, while the dishwasher is shown as a combination drawer and conventional model, it should be apparent that incorporation of the present invention in a dual drawer model, as well as a single drawer version, is equally acceptable. In addition, while the latching mechanism is illustrated on only one side of the drawer, a second latching mechanism could be arranged on the opposing side. In general, the invention is only intended to be limited to the scope of the following claims.

We claim:

1. A dishwasher comprising:

a frame assembly;

a drawer slidably mounted in the frame assembly and forming a washing chamber, said drawer including a first spray arm for spraying a washing fluid on objects within the washing chamber and a drain for permitting the draining of the washing fluid from the washing chamber;

a lid assembly pivotally mounted to the frame assembly for selectively sealing the washing chamber during a washing operation, and a second spray arm for spraying washing fluid onto objects within the washing chamber;

a closing mechanism for pivotally moving the lid assembly from a first position, wherein the drawer is permitted to slide from the frame assembly, and a second position, wherein the lid assembly is forced against the drawer to substantially seal the washing chamber, said closing mechanism including a linkage system having a plurality of links, with at least one of the plurality of links constituting a compressive link tolerance accumulator; and a latching mechanism for selectively locking the drawer in the frame assembly including:

a latching member mounted to a front portion of the drawer;

a locking member mounted to a rear portion of the drawer, said locking member including a lid engagement portion adapted to matingly receive a portion of the lid assembly; and a linking bar interconnecting the latching member with the locking member, whereby movement of the latching member causes pivotal movement of the locking member through the in lining bar.

2. A dishwasher comprising:

a frame assembly;

a drawer slidably mounted in the frame assembly and forming a washing chamber, said drawer including a first spray arm for spraying a washing fluid on objects within the washing chamber and a drain for permitting the draining of the washing fluid from the washing chamber;

a lid assembly pivotally mounted to the frame assembly for selectively sealing the washing chamber during a washing operation;

a closing mechanism for pivotally moving the lid assembly from a first position, wherein the drawer is permitted to slide from the frame assembly, and a second position, wherein the lid assembly is forced against the drawer to substantially seal the washing chamber, said closing mechanism including at least one compressive link tolerance accumulator;

wherein the closing mechanism includes first and second opposing in linkages interconnecting the lid assembly with the frame assembly, and each of said first and second opposing in linkages includes at least one link, the at least one link being constituted by the compressive link tolerance accumulator;

and a latching mechanism for selectively locking the drawer in the frame assembly during the washing operation.

3. The dishwasher according to claim 2, wherein the closing mechanism includes first and second opposing pairs of linkages interconnecting the lid assembly with the frame assembly.

4. The dishwasher according to claim 3, wherein each of said first and second opposing pairs of linkages includes at least one link, the at least one link being constituted by the compressive link tolerance accumulator.

5. The dishwasher according to claim 2, wherein the compressive link tolerance accumulator includes a first portion slidably connected to a second portion through a coil spring.

6. The dishwasher according to claim 5, wherein at least one of said first and second portions further includes a latching clip for limiting relative movement between the first and second portions.

7. A dishwasher comprising:

a frame assembly;

a drawer slidably mounted in the frame assembly and forming a washing chamber, said drawer including a first spray arm for spraying a washing fluid on objects within the washing chamber and a drain for permitting the draining of the washing fluid from the washing chamber;

a lid assembly pivotally mounted to the frame assembly for selectively sealing the washing chamber during a washing operation;

a closing mechanism for selectively holding the lid assembly against the drawer; and a latching mechanism for selectively locking the drawer in the frame assembly including:

a latching member mounted to a front portion of the drawer;

a locking member pivotally mounted to a rear portion of the drawer, said locking member including a lid engagement portion adapted to matingly receive a portion of the lid assembly; and a linking bar interconnecting the latching member with the locking member, whereby movement of the latching member causes pivotal movement of the locking member through the linking bar.

8. The dishwasher according to claim 7, wherein the latching mechanism further includes a locking bar movable relative to the drawer, said locking bar being adapted to engage the locking member to prevent the locking member from rotating when the drawer is withdrawn from the frame assembly.

9. The dishwasher according to claim 8, wherein the locking bar is movable with the drawer into and out of the frame assembly.

10. The dishwasher according to claim 8, wherein the locking bar is provided with a pin and the locking member is provided with a pin receiving notch, said pin being located in the pin receiving notch to prevent the locking member from rotating when the drawer is withdrawn from the frame assembly.

11. The dishwasher according to claim 10, wherein the locking member includes a cam surface extending between the lid engagement portion and the pin receiving notch of the locking member.

12. The dishwasher according to claim 11, wherein the latching mechanism further includes a micro-switch for interrupting power to at least a portion of the dishwasher when the drawer is withdrawn from the frame assembly, said micro-switch being operated through engagement with the cam surface of the locking member.

13. The dishwasher according to claim 8, wherein the latching mechanism includes a spring located between the locking bar and the drawer, said spring biasing the locking bar toward the locking member.

14. The dishwasher according to claim 7, wherein the closing mechanism includes an over-center spring element to bias the lid assembly against the drawer.

15. The dishwasher according to claim 7, wherein the latching mechanism further includes a latch member for rotating the locking member, said latch member being attached to a drawer front member.

16. The dishwasher according to claim 7, wherein the latch member constitutes a drawer front member.

17. The dishwasher according to claim 16, wherein the drawer front member is pivotally attached to the front portion of the drawer.

* * * * *

UNITED STATES PATENT AND TRADEMARK OFFICE

CERTIFICATE OF CORRECTION

PATENT NO. : 7,607,444 B2
APPLICATION NO. : 11/288290
DATED : October 27, 2009
INVENTOR(S) : Gunnerson et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1002 days.

Signed and Sealed this

Twelfth Day of October, 2010

David J. Kappos

David J. Kappos
*Director of the United States Patent and Trademark Office*